United States Patent [19]

Shan-Pao

[11] Patent Number: 4,909,467

[45] Date of Patent: Mar. 20, 1990

[54] HOLDER FOR BOTTLES AND TOOLS

[76] Inventor: Chang Shan-Pao, 3Fl. No. 28, Lane 133, Hsin Sheng N. Rd. Sec. 2, Taipei, Taiwan

[21] Appl. No.: 308,078

[22] Filed: Feb. 9, 1989

[51] Int. Cl.[4] ..... A47K 1/08

[52] U.S. Cl. ..... 248/312; 24/495; 24/515; 24/537; 211/75; 248/113; 248/313

[58] Field of Search ..... 248/312, 309.1, 313, 248/316.5, 324, 108, 113, 540; 24/495, 515, 537; 269/254 R, 238; 232/41 R, 41 B, 41 E; 211/75, 70.6, 89, 65, 66

[56] References Cited

U.S. PATENT DOCUMENTS

| | | | |
|---|---|---|---|
| 113,313 | 4/1871 | Linsey | 24/537 |
| 225,000 | 3/1880 | Dickson | 269/238 X |
| 1,589,818 | 6/1926 | Ritter | 248/113 |
| 1,644,539 | 10/1927 | Minto | 232/4 E |
| 2,616,647 | 11/1952 | Murchinson | 248/312 X |

FOREIGN PATENT DOCUMENTS

| | | | |
|---|---|---|---|
| 0063791 | 2/1913 | Switzerland | 24/537 |

*Primary Examiner*—Ramon O. Ramirez
*Attorney, Agent, or Firm*—Varndell Legal Group

[57] ABSTRACT

A holder includes a securing plate having two spaced mounting sleeves having two axes defining an obtuse including angle, and two holding arms having two first bent ends respectively mounted in the mounting sleeves and two second opposite ends which form a holding mouth which will open when the arms are upwardly pivoted and will close to be able to hold therebetween an object when the holding arms are downwardly pivoted.

4 Claims, 4 Drawing Sheets

HOLDER FOR BOTTLES AND TOOLS

BACKGROUND OF THE INVENTION

The present invention relates to a holder, and more particularly to a holder secured to a wall.

The hooks on the supporting frame for the tool in the factory have various sizes and shapes in order to cope with the necessity of various tools. Since a specific hook can only be used with a specific tool, such a hook lacks flexibility. In addition, if some home tools or bottled articles, e.g. a screwdriver or a bottle of flavoring, are not suitably stored, they are not readily retrievable or can be easily broken.

It is therefore attempted by the Applicant to deal with the above situation.

SUMMARY OF THE INVENTION

It is therefore an object of the present invention to provide a holder capable of neatly holding thereon any an object having a holded portion having a size in a particular range.

According to the present invention, a holder includes a securing plate having two spaced mounting sleeves having two axes defining an obtuse including angle, and two holding arms having two first bent ends respectively pivotally mounted in the sleeves and two second opposite ends which form a holding mouth which will open when the arms are upwardly pivoted and will close to be able to hold therebetween an object when the arms are downwardly pivoted.

The present invention may best be understood through the following description with reference to the accompanying drawings, in which:

DETAILED DESCRIPTION OF THE PREFERRED EMBODIMENT

Figure 1:
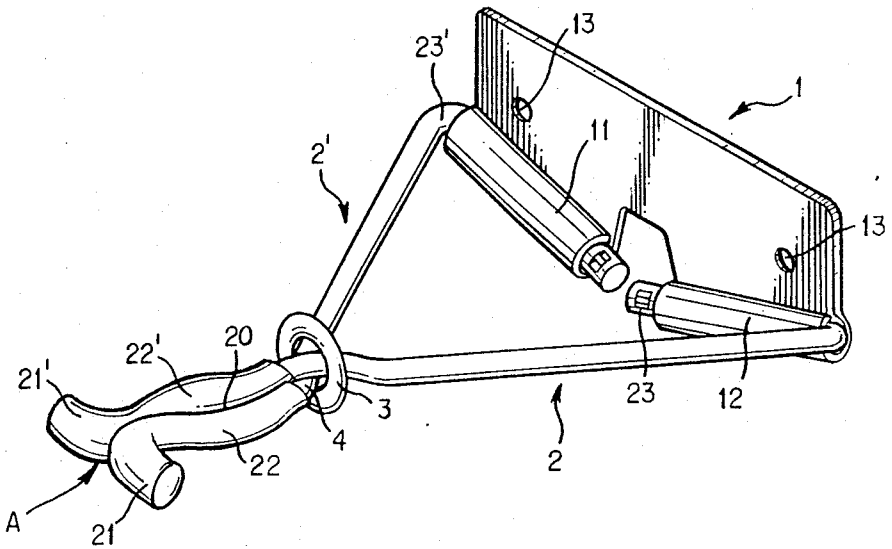
FIG. 1 is a perspective view of a holder according to the present invention.
Figure 2:
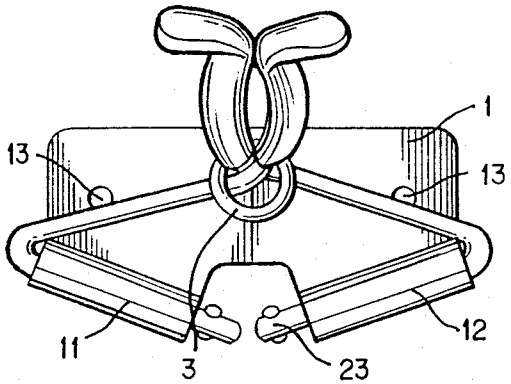
FIG. 2 is a front view schematically showing a force diagram of a holder in FIG. 1.
Figure 3:
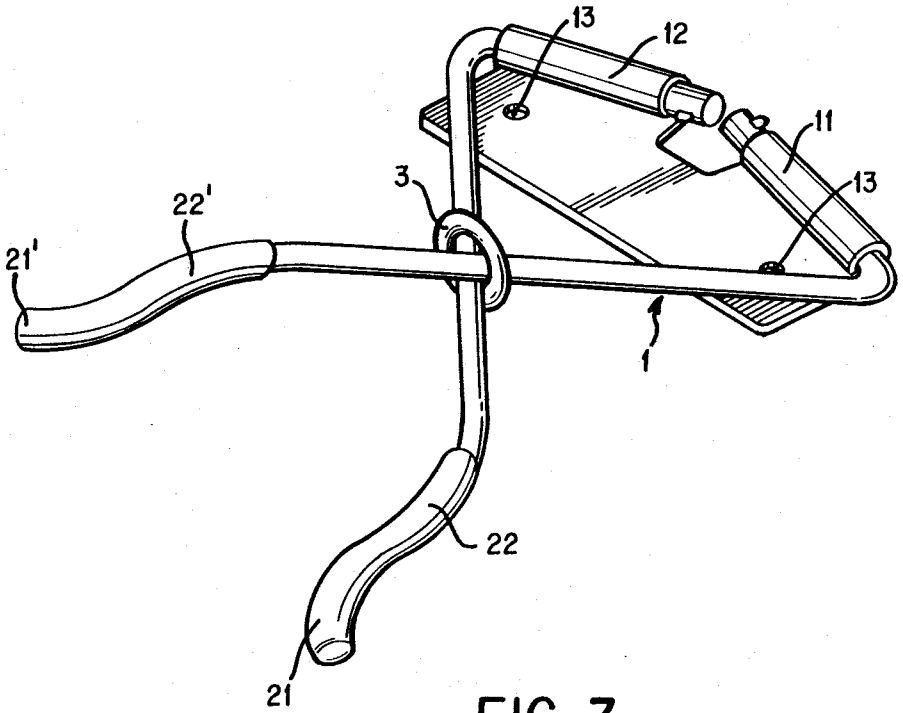
FIG. 3 is a perspective view showing a holder in FIG. 1 being upwardly pivoted.
Figure 4:
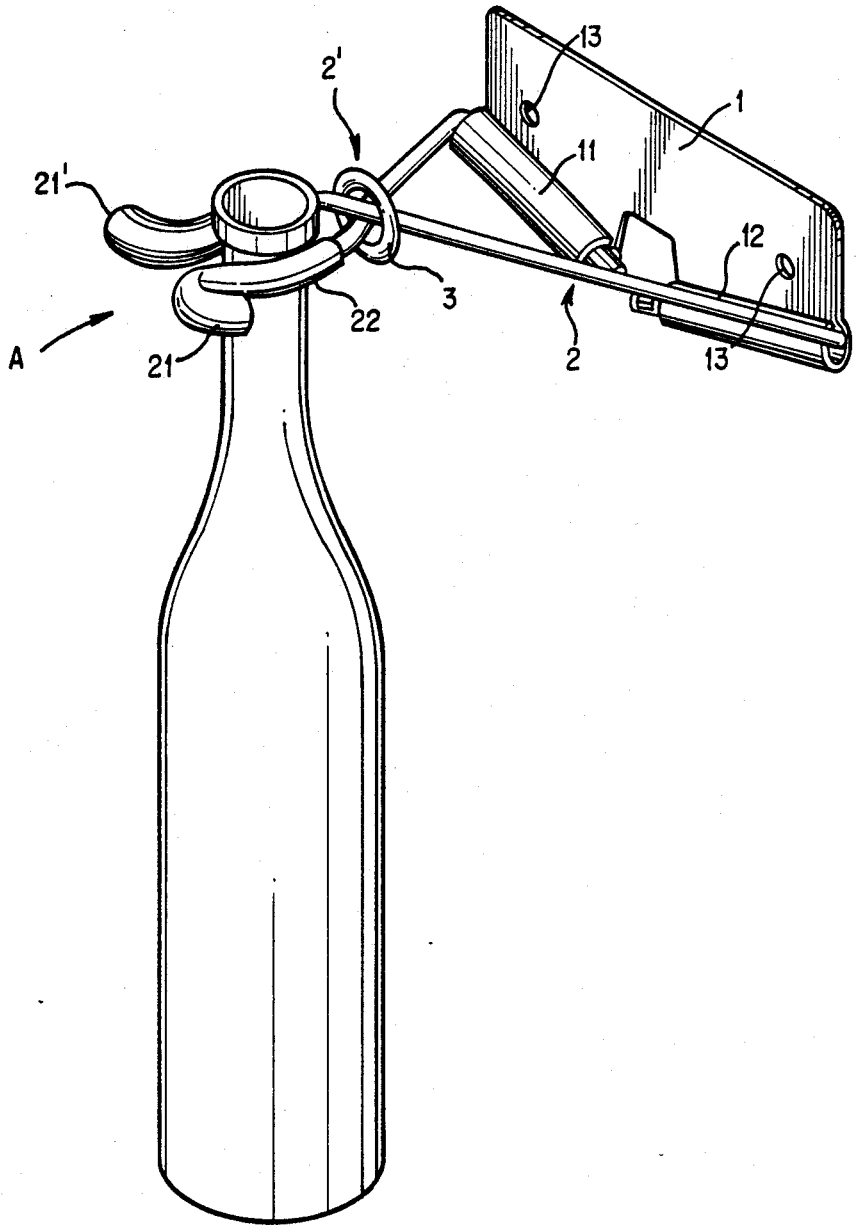
FIG. 4 is a perspective view showing a holder in FIG. 1 holding thereon a bottle.

Referring now to FIGS. 1 to 4, a holder according to the present invetnion includes a securing plate 1, two holding arms 2, 2', a confining ring 3, and two rubber sleeves 4. Securing plate 1 includes two spaced symmetrical mounting sleeves 11, 12 having two axes thereof defining an obtuse including angle, which can be, for example, about 140°, and two securing holes 13 through which plate 1 can be secured to a wall.

Holding arms 2, 2' are rod members and include two first bent ends 23, 23' respectively pivotally mounted in sleeves 12, 11, and two second opposite ends which form thereon a holding mouth 20 defined by two outer guiding portions 21, 21' and two inner curved holding portions 22, 22'.

Confining ring 3 is sleeved on the connected second opposite ends of arms 2, 2' for always confining together arms 2, 2' no matter what they are pivoted with respect to sleeves 12, 11. Two encapsulating rubber sleeves 4 are respectively sleeved on the second opposite ends of arms 2, 2' for increasing the frictional coefficient between holding mouth 20 and the object to be held thereon.

In operation, a bottle or the like is first inserted from the front end A of arms 2, 2' into holding mouth 20 during which arms 2, 2' are upwardly pivoted. Thereafter, the weight of the bottle and arms 2, 2' will downwardly pivot arms 2, 2' with respect to sleeves 12, 11 to automatically hold thereon and clamp therein the neck portion of the bottle.

What I claim is:

1. A holder comprising:

a securing plate for securing said holder to a wall, said securing plate having thereon two mounting sleeves spaced apart with their respective axes defining an obtuse angle therebetween;

two holding arms, each said holding arm having a first bent end respectively pivotally mounted in one of said sleeves and a second end for holding an object; and a confining ring encompassing said holding arms for confining said holding arms together with said second ends forming a mouth therebetween;

wherein said mouth is opened when said arms are pivoted in a first direction and said mouth is closed when said arms are pivoted in an opposite direction by action of said holding arms together with said sleeves having said obtuse angle therebetween.

2. A holder as claimed in claim 1, wherein said sleeves are symmetrically formed on said securing plate and said obtuse angle is about 140°.

3. A holder as claimed in claim 1, wherein said holding arms are rod members and each of said second opposite ends includes an outer guiding portion and an inner curved holding portion.

4. A holder as claimed in claim 1, wherein said second opposite ends are provided thereon with encapsulating rubber sleeves respectively.

* * * * *